United States Patent [19]

Simonsson

[11] 4,060,050

[45] Nov. 29, 1977

[54] FILL INDICATOR FOR A VACUUM CLEANER DUST COLLECTOR

[75] Inventor: Sven Bertil Simonsson, Tyreso, Sweden

[73] Assignee: Aktiebolaget Electrolux, Stockholm, Sweden

[21] Appl. No.: 715,303

[22] Filed: Aug. 18, 1976

[30] Foreign Application Priority Data

Aug. 29, 1975 Sweden ..... 7509600

[51] Int. Cl.[2] ..... G01P 13/08; G01L 7/16

[52] U.S. Cl. ..... 116/114 AD; 55/274; 73/396; 116/114 PV; 116/DIG. 25

[58] Field of Search ..... 116/114 AD, 114 PV, 116/DIG. 25; 73/396; 55/274; 15/DIG. 11

[56] References Cited

U.S. PATENT DOCUMENTS

| | | | |
|---|---|---|---|
| 2,174,443 | 9/1939 | Lofgren | 116/114 AD X |
| 2,325,188 | 7/1943 | Lofgren | 55/274 |
| 2,365,962 | 12/1944 | Kahn | 73/396 |
| 3,119,369 | 1/1964 | Harland et al. | 73/38 X |
| 3,639,998 | 2/1972 | Masson | 55/274 X |

FOREIGN PATENT DOCUMENTS

| | | | |
|---|---|---|---|
| 686,887 | 2/1953 | United Kingdom | 73/396 |
| 669,291 | 4/1952 | United Kingdom | 73/396 |

*Primary Examiner*—Daniel M. Yasich
*Attorney, Agent, or Firm*—Alfred E. Miller

[57] ABSTRACT

An indicator device mounted on a vacuum cleaner housing which is under the influence of the pressure differnce between the inlet and outlet of a dust or dirt collector unit of the vacuum cleaner. The outer surface of the indicator device has markings that are continuously visible, and which show the amount of accumulated dust and dirt filling in the dust collector, at any given time.

5 Claims, 2 Drawing Figures

FILL INDICATOR FOR A VACUUM CLEANER DUST COLLECTOR

BACKGROUND OF THE INVENTION

Visible indicators ar known for use with a vacuum cleaner which show, at a glance, the amount of filling of a disposable dust or dirt collector, so that the latter can be replaced with a new dust collector. Some of these indicators work on the principle of the measurement of the pressure difference between the inlet and outlet respectively of a dust collector. This pressure difference is utilized to move a piston in a cylinder a distance which corresponds to the magnitude of the pressure difference. Thus, when the piston moves to a given position it signals that the pressure difference, as stated hereinbefore, has reached such a magnitude that the container or bag replacement is necessary. However, since there is a pressure difference between the two ends of the piston the visual indicator has a serious drawback in that the seals between the piston and cylinder, for example scaling rings, are required to maintain the accurate pressure difference in order to ensure that the visual indicator will operate in a safe manner. The piston rings require grooves in the external circumferential surface of the piston which obviously increases the cost of manufacture. Furthermore, the foregoing arrangement increases the friction resulting from the piston reciprocating within the cylinder which has the undesirable result of reducing the precision of the indicator device. Moreover, small measures of deviations in the manufacture of the indicator device may cause incorrect indications in some indicators as well as calibration difficulties.

The present invention relates to a visual indicator for a vacuum cleaner, or the like, which apprises the operator when the dust receptacle or bag requires replacement.

It is an object of the present invention to provide a cylindrical piston which is rotatably journalled in a transparent cylinder communicating with the inlet of a dust collector. The piston has a shaft with the forward end threaded and is further provided with a nut which is operatively connected to a diaphragm located in a chamber communicating with the outlet of the dust colllector. The action or movement of the diaphragm, due to changes in relative pressure, causes the piston to move rotatably in the cylinder and thereby display readings that indicate the amount of filling present in the dust container at any given time.

It is another object of the present invention to provide a locking arrangement which locks the piston to the cylinder at the position it has assumed as a result of the pressure differences between the inlet and outlet of the cylinder.

It is a further object of the present invention to provide a continuously operable indicator for a vacuum cleaner dust container or bag that is reliably effective for the purposes intended.

In order that the invention will be more clearly understood, it will now be disclosed in greater detail with reference to the accompanying drawings, in which:

FIG. 1 is a cross sectional view of an indicator device for continuously showing the amount of filling in a vacuum cleaner dust collector or bag constructed in accordance with the teachings of the present invention, and FIG. 2 is an exploded perspective view of the cylinder and its associated piston that comprises said indicator device.

DESCRIPTION OF THE PREFERRED EMBODIMENT

Figure 1:
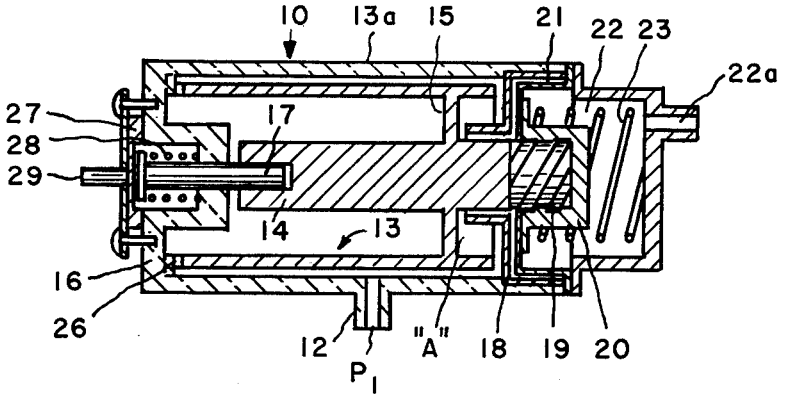

As seen in FIG. 1, the indicator device is designated generally by the reference numeral 10 and comprises a transparent cylinder 11 having a spigot tube 12 which is connected to the inlet of a dust container or bag where an atmosphere P1 prevails. A hollow piston 13 is illustrated as being rotatably journalled in the cylinder 11 be means of a shaft 14 disposed centrally within said piston and by means of radial portions 15 supporting the circumferential outer surface 13*a* of the piston 13. As seen in FIG. 1, the wall 16 of the cylinder 11 has a journal 17 passing therethrough which is disposed longitudinally and centrally and supports one end of the shaft 14. The other end of the shaft 14 is mounted in the cylinder 11 in an opening in the wall 18 of the cylinder and the end adjacent thereto of the shaft 14 is in the form of a screw thread 19 that is adapted to co-act with a nut 20. As clearly seen in FIG. 1, the nut 20 is fixed to the diaphragm 21 which in turn partitions off a chamber 22 from the interior of the cylinder 11. The chamber communicates with the nipple 22*a* and with the outlet of the dust collector. The foregoing arrangement senses an absolute pressure P2 in the chamber 22. A compression spring 23 is positioned between the nut 20 and the end wall of the chamber 22 and this spring tends to keep the diaphragm 21 in its initial position through the nut 20.

When the absolute pressure P2 at the outlet of the dust collector starts falling due to the increased filling of the dust collector or bag the diaphragm 21 moves to the right in FIG. 1 against the action of the spring 23. By means of the nut 20 on the screw thread 19, the linear movement of the diaphragm is transformed into a rotary movement of the piston 13. It is preferable to have symbols on the exterior surface of the piston, for example, colored fields (not shown) which indicate the degree or amount of filling of the dust collector or bag. The various colored fields can be seen from the exterior of the vacuum cleaner relative to markings on the transparent cylinder 11. Therefore, at any given time, the amount of filling in the dust collector or bag can be determined.

Figure 2:
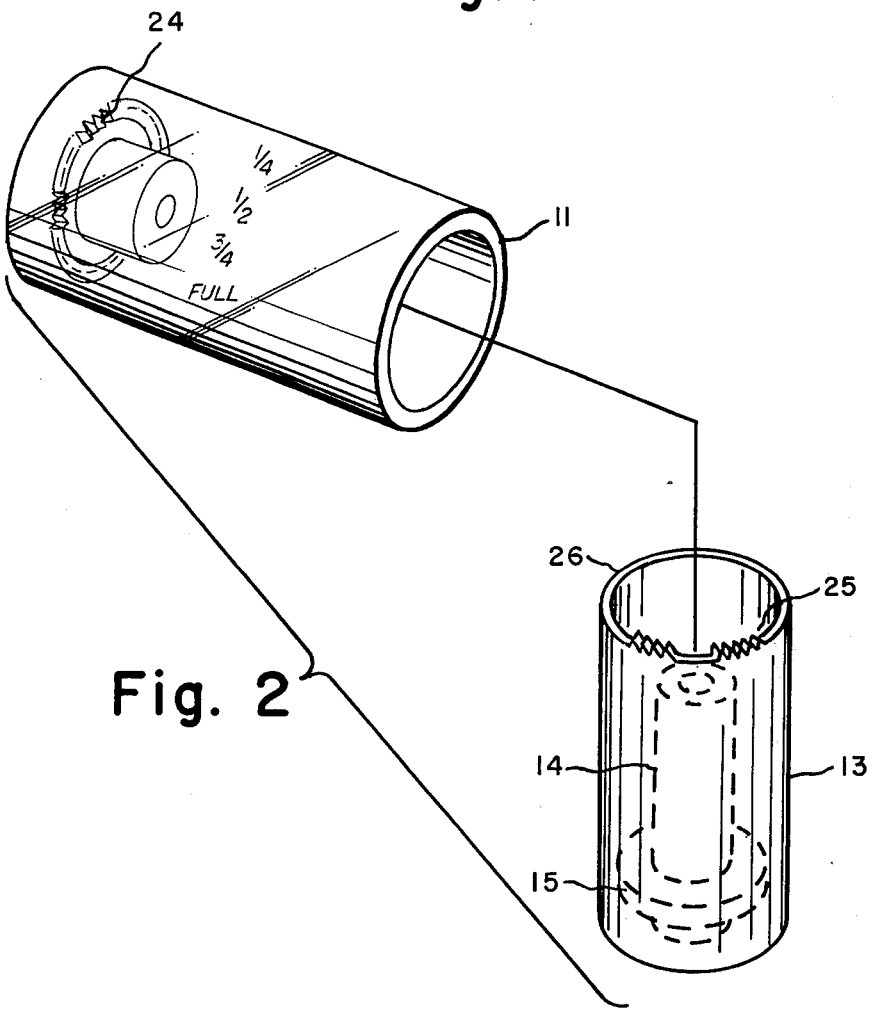

A latching or retaining device is shown in FIG. 2 having co-acting elements 24–25 for retaining the piston 13 in the position into which it has been moved when th vacuum cleaner is inoperative, thus denoting or indicating the amount of filling in the dust collector at any given time. It is evident that this device has the desirable result of allowing the user to decide when the dust collector should be replaced. Furthermore, the latching or retaining device has means for either manual or automatic release which are acted upon when the dust collector is changed. Both the latching or retaining device, and the means for releasing the same are described hereinafter.

As seen particularly in FIG. 2, the inner surface of the end wall 16 of the cylinder 11 is provided with a circumferential ring of teeth 24. A second row of circumferential teeth are shown provided on the back end of the piston 13 and the space confronting teeth 24 and 25 are adapted to be engaged together by the action of compression spring 23. As seen in FIG. 1, the piston 13 is journalled in the transparent cylinder 11 with a certain amount of axial play A which is greater than the depth of engagement of the blocking teeth 24 and 25, respectively. Thus, when the pressure difference in the indicator device increases because of a falling absolute pressure P2 the piston is moved by means of the diaphragm 21 a small distance to the right, as seen in FIG. 1. When this occurs the rows or rings of teeth 24 and 25 respectively are spaced apart and the turning movement of the piston is permitted upon the contained increase of the pressure difference. It should be apparent that the turning movement of the piston 13 occurs without it being necessary to overcome the friction caused because of the engagement of the blocking teeth. In this manner, a very accurate reading of the indicating device is possible. In a similar manner, when the pressure difference P1-P2 ceases, and the pressures in the cylinder 11 and the chamber 22 are equalized, for example when the motor-fan unit of a vacuum cleaner is inoperative, the piston 13 is moved in an axial direction a slight amount to the left in FIG. 1, so that the blocking teeth 24, 25 engage and the turning movement of the piston to its initial position is prevented. Thus, the piston, in its blocked position, indicates the degree of filling of the dust collector and this can be easily visible through the transparent wall of the cylinder 11 by means of suitable symbols on the outer peripheral surface of the piston 13.

Moreover, the indicator device can also be acted upon manually to assume its initial position. This can be achieved since the journal 17 supporting the shaft 14 of the piston 13 has a push button 29. The latter projects through the end wall 16 and is connected to the journal 17 be means of a sealing diaphragm 27 against the action of a further compression spring 28. The push button 29 therefore can be pushed in an axial direction so that the blocking teeth 24 and 25 will disengage and the piston will be permitted to turn back to its initial rest position. Thereafter, the shaft is moved to the left as seen in FIG. 1 under the action of the spring 23 and the respective blocking teeth 24 and 25 will engage each other. Inasmuch as there is no friction to overcome in the latching or retaining device, the present signal device will be more sensitive than heretofore and will indicate even small pressure difference prevailing within the device. It should be thus apparent that the present construction has definite advantages over known signal devices of this type. Furthermore, the release system can be of a simple arrangement which works automatically by means of the push button 29 being acted upon by means of an arm (not shown) when the cover of the vacuum cleaner is open for replacement of the dust collelctor.

The above described embodiment is not meant to limit the present invention, and it is obvious that several modifications are possible within the scope of the present inventive concept.

What is claimed is:

1. An indicator for visually denoting the amount of dust or dirt in a dust receptacle of a vacuum cleaner or the like comprising: a trasparent cylinder, a piston having indicia is rotatably journalled in said cylinder and communicating with the inlet of said dust receptacle that has a predetermined pressure, the outer surface of said cylinder being provided with marking for continually indicating the amount of filling of the dust collector, said piston being provided with a central shaft having a threaded end projecting from the forward end of said piston, a nut adapted to be screw-connected to said threaded end, and a diaphragm communicating with the outlet of said dust receptacle and fixed to said nut, the pressure difference between the inlet and outlet of said dust receptacle causing said diaphragm to effect a translating movement which causes the threaded shaft of said piston to turn within said nut thereby rotating said piston in said cylinder, a latching means on said piston and cylinder which co-acts to retain said piston in the position it has assumed in the cyliner due to said pressure difference, said latching means including a first row of teeth at the end of the piston remote from said diaphragm, a spring engaging said nut on the opposite side from the diaphragm and biasing said piston rearwardly towards said first row of teeth, and a second row of teeth on a surface of said cylinder facing said first row of teeth, said spring urging said first and second row of teeth into latching engagement when said vacuum cleaner is inoperative.

2. An indicator as claimed in claim 1 wherein said piston has a predetermined amount of axial play that exceeds the depth of engagement of the mating first and second rows of teeth.

3. An indicator as claimed in claim 1 wherein said piston is journalled in an end wall of said cylinder remote from said diaphragm.

4. An indicator as claimed in claim 3 wherein said piston is movable within said cylinder to a position in which the first and second rows of teeth latching means are disengaged from one another, and in said position said spring is capable of turning said piston to its original rest position by means of the co-action of said nut and the threaded end of the central shaft of said piston.

5. An indicator as claimed in claim 1 wherein the indicia is provided on the exterior surface of said piston as colored symbols to denote visually the degree of filling of said dust collector at any given time.

* * * * *